US009284858B2

(12) United States Patent
Demuth et al.

(10) Patent No.: US 9,284,858 B2
(45) Date of Patent: Mar. 15, 2016

(54) METHOD AND PARTS FOR MAKING A TUBULAR WORKPIECE, IN PARTICULAR A BUILT-UP CAMSHAFT

(75) Inventors: Rico Demuth, Wiesa (DE); Jens Gentzen, Lichtenau (DE); Juergen Meusel, Dittmannsdorf (DE); Alexander Paul, Reichenbach (DE); Daniel Paul, Burkhardtsdorf (DE); Robert Reichelt, Frankenberg/Sachsen (DE); Frank Schieck, Lauter (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 370 days.

(21) Appl. No.: 13/880,262

(22) PCT Filed: Nov. 17, 2011

(86) PCT No.: PCT/EP2011/070397

§ 371 (c)(1),
(2), (4) Date: Aug. 7, 2013

(87) PCT Pub. No.: WO2012/066099

PCT Pub. Date: May 24, 2012

(65) Prior Publication Data

US 2013/0305532 A1 Nov. 21, 2013

(30) Foreign Application Priority Data

Nov. 19, 2010 (DE) ..... 10 2010 060 686

(51) Int. Cl.

| | |
|---|---|
| ***F01L 1/047*** | (2006.01) |
| ***B21D 26/045*** | (2011.01) |
| ***B21D 39/06*** | (2006.01) |
| ***B21D 53/84*** | (2006.01) |

(52) U.S. Cl.

CPC ..... *F01L 1/047* (2013.01); *B21D 26/045* (2013.01); *B21D 39/06* (2013.01); *B21D 53/845* (2013.01); *F01L 2001/0471* (2013.01); *Y10T 29/49293* (2015.01); *Y10T 29/53996* (2015.01)

(58) Field of Classification Search

CPC ..... B21D 26/033–26/051; B21D 53/845; Y10T 29/4994; Y10T 29/49938; Y10T 29/49293; F01L 1/047–1/06

See application file for complete search history.

(56) References Cited

U.S. PATENT DOCUMENTS 3,112,564 A * 12/1963 Murray ..... B21D 39/04 228/136
4,660,269 A 4/1987 Suzuki
5,201,247 A 4/1993 Maus (Continued)

*Primary Examiner* — Jason L Vaughan
(74) *Attorney, Agent, or Firm* — Andrew Wilford

(57) ABSTRACT

The invention relates to a method for producing a tubular structural part by means of hydroforming. An assigned end of a supporting tube (1) is inserted into an opening in an end piece (2) and then widened by a pressurized fluid being applied to it and is connected to the end piece (2) with a press fit. The opening (9) has a first portion (10*a*) with a first inner cross section, which is greater than the outer cross section of the assigned end of the supporting tube (1). According to the invention, the first portion (10*a*) is adjoined by a second portion (10*b*), in a step-shaped manner so as to form an edge (11). The inner cross section of the second portion (10*b*) is smaller than the outer cross section of the assigned end of the supporting tube (1). In the method according to the invention, the supporting tube (1) is first inserted with its corresponding end into the first portion (10*a*), before the edge (11) cuts into the material of the supporting tube (1) in a further pushing-in movement.

18 Claims, 2 Drawing Sheets

(56) References Cited

U.S. PATENT DOCUMENTS

| | | | | |
|---|---|---|---|---|
| 5,979,386 | A * | 11/1999 | Swars | B21D 53/845 123/90.6 |
| 6,192,582 | B1 | 2/2001 | Swars | |
| 6,935,292 | B2 * | 8/2005 | Spiegel | F01L 1/047 123/90.27 |
| 7,055,238 | B2 * | 6/2006 | Spielmannleitner | B21D 26/033 29/505 |
| 8,286,319 | B2 * | 10/2012 | Stolle | B21D 26/035 285/382.5 |
| 8,720,055 | B2 * | 5/2014 | Flender | F01L 1/047 123/90.17 |
| 2004/0173050 | A1 | 9/2004 | Asbeck | |
| 2006/0103168 | A1 * | 5/2006 | Ueno | B21D 26/045 296/187.02 |
| 2007/0163319 | A1 | 7/2007 | Gade | |
| 2007/0277574 | A1 * | 12/2007 | Schroeder | B21D 26/045 72/61 |
| 2014/0174248 | A1 * | 6/2014 | Paul | B21D 53/845 74/567 |

* cited by examiner

METHOD AND PARTS FOR MAKING A TUBULAR WORKPIECE, IN PARTICULAR A BUILT-UP CAMSHAFT

CROSS REFERENCE TO RELATED APPLICATIONS

This application is the US-national stage of PCT application PCT/EP2011/070397 filed 17 Nov. 2013 and claiming the priority of German patent application 102010060686.3 itself filed 19 Nov. 2010.

FIELD OF THE INVENTION

The invention relates to a method of making a tubular structural element, in particular a built-up camshaft, by hydroforming, where a support tube and an end piece are supplied, one end of the support tube being inserted into a cavity in the end piece and subsequently expanded by action of a pressurized fluid and connected to the end piece with a press fit, and the cavity, prior to being acted on by the pressurized fluid, having a front portion that has an inner cross section that is larger than the outer cross section of the one end of the support tube. Moreover, the subject matter of the invention involves a set of parts for making a tubular structural element, the set of parts having a support tube, an end piece having a cavity for the support tube, and functional elements, for example cams, provided for mounting on the support tube.

BACKGROUND OF THE INVENTION

A built-up camshaft is understood to mean a camshaft that is produced not in one piece in a primary forming or shaping process, but, rather, by connecting multiple prefabricated parts together. Recent built-up camshafts have, in addition to cams, further functional elements such as end pieces, a chain wheel, belt pulleys, sensor wheels, pump drives, roller bearings, slide bearings, or the like, that must be fastened to a support tube using a suitable joining technology, for which very high angular accuracies must also be maintained.

In practice, making built-up camshafts by hydroforming has proven successful, in that in one process step multiple cams and/or other functional elements are simultaneously fastened to a support tube with a press fit. In hydroforming, the cams and the other functional elements that may be provided are initially pushed with play onto the support tube with their hubs and positioned, the support tube subsequently being acted on by a high internal pressure, as the result of which the support tube is expanded elastically and plastically and fitted against the inner surface of the hubs. The cams and other functional elements that may be provided are also expanded to a certain extent, although this expansion preferably occurs only elastically. After the action of pressure is discontinued, the support tube as well as the elements situated thereon spring back elastically, the materials of the joining partners being selected in such a way that the cams and other functional elements are held on the support tube with a press fit via elastic residual stress.

Hydroforming is usually carried out in a mold that limits radial expansion due to the action of pressure. According to one preferred embodiment of the hydroforming process, when the support tube is acted on by a pressurized fluid over its entire length, an adequate seal must be ensured. In addition, in hydroforming it is the aim to allow reliable transmission of high torques with the lowest possible material use and with a simple construction.

When hydroforming is carried out in a mold, a pressure source is usually connected at one end of the support tube, while the end of the support tube opposite the pressure source must be sealed pressure-tight, for which purpose end pieces that are mounted like a cap may be used. Another variant is the option for pressure medium entering through an axial borehole in the end piece. The tube is sealed pressure-tight on the opposite end. A reliable seal is necessary to avoid the uncontrolled escape of pressurized fluid, and thus, failure of the joining process.

A method of making a built-up camshaft having the features described above is known from DE 36 16 901 [U.S. Pat. No. 4,660,269]. The production of the tubular structural element in the form of a built-up camshaft is carried out in a closed mold, a source for the pressurized fluid being connected to one end of the support tube, and end an end piece being pushed onto the other end of the support tube during the hydroforming process. Various measures are proposed for achieving a seal. Placing a sealing ring in a radial groove or at the base of the cavity in the end piece is complicated, and leaks of the polymeric sealing material cannot be ruled out on account of the very high pressures of typically 2000 to 5000 bar that act during hydroforming. Alternatively, it is proposed to provide the cavity as a blind hole with a frustoconical bevel at its base against that the support tube is pressed. Only linear contact is gained around the periphery, which cannot ensure a reliable seal in the event of dimensional deviations, out-of-round eccentricities, and localized damage. In addition, producing such frustoconical surfaces at the base of the cavity is complicated.

OBJECT OF THE INVENTION

Against this background, the object of the invention is to provide a method of making a tubular structural element in which an end piece may be easily secured with a high degree of reliability and reproducibility by hydroforming. A further aim is to provide a set of parts that is suitable for carrying out the production method.

SUMMARY OF THE INVENTION

Based on a method having the features described above, the object is attained according to the invention in that, starting from the front end of the cavity, the front portion forms a step with a rear portion having a rear inner cross section that is smaller than the outer cross section of the one end of the support tube, the step forming a circumferential edge, the support tube with its one end initially being inserted into the front portion, and the edge cutting into the material of the support tube during a further insertion movement. The step, which is usually approximately a right angle, defines a comparatively sharp cutting edge that engages in the area of the end face of the support tube when the one end of the support tube is inserted, and cuts into the material at that location. Material shaping as well as a certain material shearing may take place during this cutting. The described procedure results in production of a wider sealing area around the periphery, thus ensuring a particularly reliable seal. In addition, after the support tube is pushed in, the end piece is prefixed to a certain extent due to the cutting of the edge, so that the support tube may be easily handled by the end piece fastened thereto before the final joining by high internal pressure.

Whereas in the tapered contact surfaces known from the prior art, essentially only distortion of the comparatively thin-walled tube occurs under a high action of force due to the oblique introduction of force, according to the present invention the relatively sharp edge, which is usually approximately a right angle, cuts in at the end face of the support tube, the introduction of force initially having a substantial axial vector, so that material shaping or shearing is intensified, and there is less distortion of the support tube.

The depth of the step is selected in such a way that the rear inner cross section that extends rearward from the step is larger than the inner cross section of the one end of the tube. This difference in the diameters results in joint play for the preassembly. In addition, the dimensions are preferably also selected in such a way that, despite the design of the step, the support tube may be pushed in, up to a floor of the cavity or at least just before the floor of the cavity, also into the area of the rear portion, with deformation and/or shearing of a portion of the tube material. A sealing material contact is then achieved essentially over the entire length of the rear portion, which is preferably between 1 mm and 8 mm, preferably approximately 4 mm, so that local unevennesses, defects, or the like do not result in an appreciable reduction of sealing, even with an application of pressure of several thousand bar. Lengthening the rear portion may be advantageous in order to compensate for nonuniform shortening of the tube as the result of forming processes. Due to the support tube being insertable at its end preferably up to the floor of the cavity, with regard to dimensional accuracy this also results in particularly high precision and reproducibility, since the floor of the cavity is used, in a manner of speaking, as a stop for the one end of the support tube.

The present invention relates in general to a method of making a tubular structural element, where the cross-sectional shape of the support tube is not initially defined. Square, rectangular, elliptical, or other cross-sectional shapes are conceivable in principle, it always being necessary to provide a circumferential edge at the transition from the front portion to the rear portion within the cavity in the end piece, the inner shape being adapted to the cavity at the outer end of the support tube.

In particular with regard to built-up camshafts, however, a circular cross section is usually provided, so that the portions of the cavity are preferably cylindrical or essentially cylindrical. The information concerning the dimensions of the inner and outer cross sections refers to a circular configuration corresponding to the internal and external diameters.

The quality of the seal on the one hand and the force required to push the support tube into the one end piece on the other hand, are a function of the dimensions of the rear inner cross section, of the length of this portion, and of the outer cross section of the tube. In this regard it is preferred for the front inner cross section to be radially oversized 0.1 mm to 1 mm, particularly preferably 0.2 mm to 0.4 mm, relative to the rear inner cross section, this dimension corresponding to the radial depth of the essentially right-angled step between the front portion and the rear portion. The play between the front inner cross section and the outer cross section of the one end of the support tube is preferably small, and is usually specifically selected so that it can be slid on without jamming. According to one preferred embodiment of the invention, the front inner cross section is oversized radially by less than 0.2 mm, particularly preferably 0.05 mm to 0.1 mm, relative to the outer cross section of the one end of the tube.

Various measures must be provided, in combination or as an alternative to one another, to ensure a secure connection to the is support tube on the end piece, and preferably also to allow the transmission of substantial torques.

First of all, the strength of the connection, and thus the torque to be transmitted, is a function of the overlap between the support tube and the tubular structural element. Thus, for a configuration having circular cross sections, according to one preferred embodiment of the invention the cavity has an overall axial length that is at least 60%, preferably at least 80%, of the internal diameter of the front portion. Based on the finished structural element, the axial length is to be determined of the support tube.

In order to achieve high joint strength during the hydroforming, it is crucial that the exterior joining partner has a greater elastic recovery than the interior support tube. Accordingly, the exterior joining partners must also be sufficiently expanded beforehand, so that the joining partner must not have an excessively large wall thickness. Thus, according to one preferred embodiment the end piece has a wall thickness between 2 mm and 4 mm in the area of the front portion of the cavity, and therefore may be sufficiently elastically expanded during hydroforming.

To improve the force-fit connection of the end piece on the support tube with a press fit, the cavity in the end piece may be pretreated by particle blasting, for example corundum blasting, shot blasting, sandblasting, or the like prior to insertion of the one end of the support tube. This increases the coefficient of friction between the joining partners. To avoid damage to the edge, which according to the invention is as sharp as possible, at the transition from the front portion to the rear portion of the cavity, the edge may be coated during the pretreatment by particle blasting.

In addition, a certain integral bond may contribute to increased strength of the connection. Thus, prior to insertion of the one end of the support tube into the end piece, it is possible to apply adhesive to the outer surface of the end and/or to the inner surface of the cavity, or also to provide the surface of the cavity and/or the outer surface of the one end of the tube with a zinc coating, so that, due to the action by the pressurized fluid during the hydroforming, the zinc layer is compressed between the two joining partners, and a force fit or integral bond is produced by press soldering in a transverse press system. The connection strength may be further increased by dynamic training. "Training" is understood to mean the generation of an additional relative motion between the joining partners, for example twisting or displacement in alternating directions.

To further improve the connection between the end piece and the one end of the support tube, in addition to the above-described force fit by a press fit, a certain form fit may also be achieved by shaping, at least in sections, of the cavity in the end piece. The shaping may be, for example, in a spiral, a pocket, internal knurling, a swaged inner shape, or the like. Shapes in which the formations extend transversely relative to the direction of torque transmission are particularly advantageous. Due to the action by high internal pressure, the tube material is deformed into the appropriate shape, resulting in a form fit in addition to the force fit. However, forming shaping requires an appropriately large wall thickness of the end piece, which to a certain extent conflicts with elastic ductility.

Within the scope of the invention, hydroforming is advantageously carried out inside a mold. Functional elements such as cams, sensor wheels, bearing rings, or the like are preferably fitted onto the support tube in the desired sequence, the end piece also being placed on one end of the support tube as described above. The support tube and the functional elements fitted on it are then inserted into a mold, and thus oriented axially and angularly relative to one another. After the mold is closed, a pressure source at the still open end of the support tube is pressed axially rearward to ensure the sealing function, before the action by a pressurized fluid from the pressure source, for example a plunger, for carrying out the hydroforming process. The support tube is expanded at a predefined pressure to the extent required for the formation and fastening.

According to one preferred embodiment, during the hydroforming the pressure source may be axially displaced in order to hold the tube tightly and compensate for shortening of the tube due to bulging. In addition to fixing the functional elements with a press fit, the hydroforming may also be used to form functional surfaces, such as bearing points, from the support tube itself. This results in the advantage that certain dimensional deviations of the originally inserted support tube are compensated for by the plastic deformation against the mold. Namely, essentially only the recovery of the support tube after the high internal pressure is discontinued is crucial for the dimensional stability. To form bearing points at portions of the support tube, the bearing points may, for example, be subjected to finish machining and/or coating, also prior to the hydroforming.

If the support tube or the end piece is not completely cleaned, and despite the good seal according to the invention in the area of the end piece, at least at the start of hydroforming, certain quantities of pressurized fluid still pass into the joint gap, or emulsion residues are also present in the lower mold half from previous forming operations, there is the risk that a liquid film may develop in the joint gap that, as a type of opposing pad and spacer, counteracts the forces exerted by the high internal pressure. In that case, it cannot be ruled out that the press fit between the joining partners is impaired, and/or that certain production deviations occur. To avoid such problems, according to one preferred embodiment of the invention at the start of the hydroforming, fluid may be discharged from the joint gap between the support tube and the end piece. For this purpose, in the area of the front portion of the cavity the end piece may have at least one radial discharge passage, for example in the form of a borehole and/or at least one longitudinally extending groove.

To avoid damage to the expanding support tube at the mouth of the cavity during the hydroforming, a radius and/or a conical expansion may be provided at that location between the front portion and the edge of the cavity. Cutting into the expanding support tube may thus be avoided. The formation of a radius or a conical expansion at the mouth of the cavity also assists in placing or premounting the end piece on the one end of the support tube in an even easier manner.

The subject matter of the invention also involves a set of parts for making a tubular structural element by hydroforming, the set of parts having at least the above-described support tube and end piece.

BRIEF DESCRIPTION OF THE DRAWING

The invention is explained below with reference to drawings that illustrate only one illustrated embodiment, and in which.

SPECIFIC DESCRIPTION OF THE INVENTION

Figure 1:
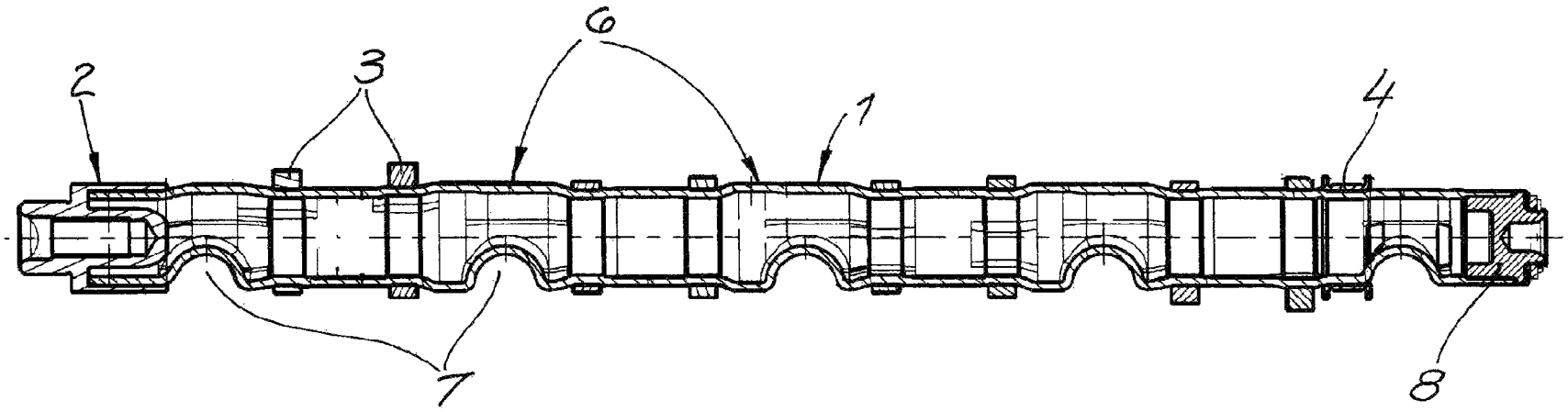
FIG. 1 is a longitudinal section of a built-up camshaft formed by hydroforming from a support tube, functional elements, and an end piece.

FIG. 1 shows the general design of a camshaft formed by hydroforming and having a support tube 1, an end piece 2 at one end of the support tube 1, and a plurality of functional elements in the form of cams 3 and an axial bearing 4. The end piece 2 and the functional elements are fastened to the support tube 1 with a press fit by hydroforming. In addition, outer formations of the support tube 1 that are used as bearing points 6 are formed by hydroforming. Screw clearances 7 in the camshaft allow access to cylinder head screws. To allow simple installation of the modular unit formed from the camshaft and cylinder head, multiple screw clearances 7 are formed in the support tube 1 over the length of the support tube 1.

In the production of the camshaft, initially the functional elements are pushed onto the support tube 1, and the end piece 2 is premounted on one end of the support tube 1. As described in detail below, pressing the end piece 2 onto the one end of the support tube 1 results in a fluid-tight connection, so that escape of pressurized fluid during subsequent hydroforming may be avoided or at least largely avoided. For hydroforming, a pressure source is connected to the support tube 1 opposite from the end piece 2, the support tube 1 together with the functional elements being in a mold that holds the functional elements in the desired axial position and angular orientation relative to one another, and also limits expansion. After the high internal pressure is ended, an end element 8 may be subsequently inserted at the locations where the pressure source is connected.

Figure 2:
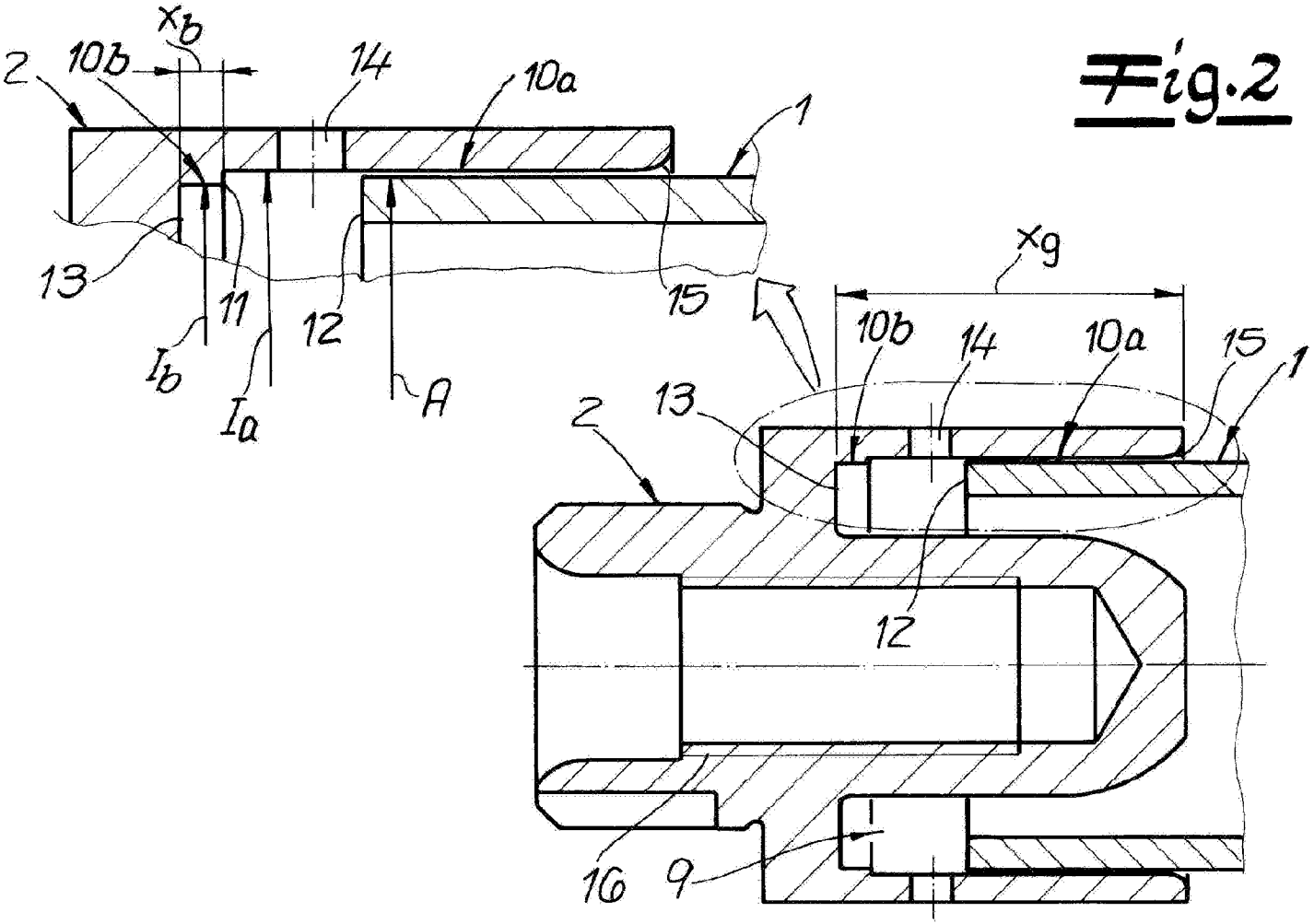
FIG. 2 is a detail view of the end piece illustrated in FIG. 1 together with the one end of the support tube, prior to hydroforming.

The end piece 2 provided according to the invention for pressure-tight sealing, as well as its end of the support tube 1, are illustrated in detail in FIG. 2, which shows the two parts prior to their connection, and accordingly, prior to shaping by high internal pressure. It is apparent in FIG. 2 that the end piece 2 has a cavity 9 including a front cylindrical portion 10*a* having an internal diameter $I_a$ and a rear portion 10*b*, directly adjoining same, having a smaller internal diameter $I_b$. The transition between the front portion 10*a* and the rear portion 10*b* is a step, the bend of approximately 90° defining an edge 11. The external diameter A of the support tube 1 is between the front internal diameter $I_a$ and the rear internal diameter $I_b$, so that the support tube 1 may initially be easily inserted into the front portion 10*a* until its end face 12 strikes the edge 11. During a further insertion movement the edge 11 cuts into the material of the support tube 1. For this purpose it is important that the material of the end piece 2 be correspondingly stronger or harder than that of the support tube 1.

The depth of the step between the front portion 10*a* and the rear portion 10*b* is selected such that the support tube 1 may be pushed, with partial shaping and/or shearing of the material, back to a floor 13 of the cavity 9 with force. Direct material contact, and accordingly, a tight connection, are thus achieved over essentially the entire axial length $x_b$ of the rear portion. In addition, as a result of the edge 11 cutting into the material of the support tube 1, the end piece 2 is already prefixed, so that the support tube 1 and the end piece 2 may be handled together. The length $x_b$ of the rear portion 10*b* is typically between 1 mm and 8 mm, preferably approximately 4 mm.

In order to achieve, as described, a good sealing effect on the one hand, and on the other hand to be able to push the support tube 1 with its end face 12 back to the floor 13 of the cavity 9, suitable dimensions for the internal diameters $I_a$, $I_b$ and the external diameter A of the one end of the support tube 1 must be established. Thus, for example, the front internal diameter $I_a$ may be 0.2 mm to 1 mm, preferably 0.4 mm to 0.8 mm, larger than the rear internal diameter $I_b$ of the rear portion 10*b*.

Preferably only a small radial gap is provided between the support tube 1 and the front portion 10*a*. Thus, for example, the internal diameter $I_a$ of the front portion 10*a* may be oversized by less than 0.2 mm, if possible, relative to the external diameter A of the support tube 1, for example oversized by 0.05 mm to 0.1 mm.

The accumulation of fluid, for example residual fluid in the mold or a small amount of leaking pressurized fluid, in the joint gap between the support tube 1 and the end piece 2 cannot be completely ruled out in all cases. To be able to discharge such fluid at the start of the hydroforming, in the illustrated embodiment a discharge passage 14 in the form of a borehole is provided. Additionally or alternatively, a longitudinally extending groove may be formed in the front portion 10*a* for discharging fluid.

To avoid the front end of the cavity 9 from being cut into when the support tube 1 expands, a frustoconical bevel 15 is provided at that location at the transition to the front portion 10*a*.

A configuration is particularly preferred in which the end piece 2 is not only used for pressure-tight closure, but also has functional features. Thus, in the illustrated embodiment a middle portion of the closed end piece 2 is provided with a thread 16 for a central screw.

In order to generate sufficient joint tension between the support tube 1 and the end piece 2, in the illustrated embodiment an overall length $x_g$ of the cavity 9 is at least 80% of the front internal diameter $I_a$.

An even further increase in the strength of the connection may be achieved, for example, by adhesive, a zinc coating, or shaping, at least in sections. For the sake of clarity, these optional measures are not illustrated in the figures.

The invention claimed is:

1. A method of hydroforming a tubular built-up camshaft, the method comprising the steps of sequentially:

providing a support tube having one end with a predetermined outer diameter;

providing an end piece formed with a cavity and having a front end at which the cavity opens, a front portion at the front end and of a front inner diameter that is larger than the outer diameter of the one end of the support tube, and a rear portion rearward in the cavity from the front portion of a rear inner diameter that is smaller than the outer diameter of the one end of the support tube, the front and rear portions forming a step defining a circumferential edge;

relatively displacing the support tube and the end piece so as to insert the one end of the support tube into the cavity of the end piece and move the support tube relative to the end piece starting from the front end of the cavity rearward toward the rear portion such that the circumferential edge cuts into the support tube; and expanding the support tube radially outward against the end piece by internally pressurizing the cavity with a fluid.

2. The method according to claim 1, further comprising the step, prior to insertion of the one end of the support tube into the cavity, of:

pretreating the cavity in the end piece by particle blasting.

3. The method according to claim 2, wherein the particle blasting modifies the edge.

4. The method according to claim 1, further comprising the step prior to insertion of the one end of the support tube into the end piece, of:

applying adhesive to an outer surface of the one end or to the inner surface.

5. The method according to claim 1, further comprising the steps of:

fitting onto the support tube functional elements each having a hub;

fitting the end piece to the one end of the support tube;

inserting an assembly comprised by the support tube fitted with the functional elements and the end piece into a mold;

closing the mold around the assembly; and internally pressurizing the assembly in the mold by the pressurized fluid.

6. The method according to claim 1, wherein the front and the rear portions as well as the one end of the tube are cylindrical.

7. The method according to claim 6, wherein the cavity has an overall length that is at least 40% of the front inner diameter.

8. The method according to claim 1, wherein the second rear portion extends over a length between 1 mm and 8 mm.

9. The method according to claim 1, wherein the front inner diameter is oversized radially 0.2 mm to 1 mm relative to the rear inner diameter.

10. The method according to claim 1, wherein the front inner diameter is oversized radially by less than 0.2 mm relative to the outer cross section of the one end of the support tube.

11. The method according to claim 1, wherein a radius or a chamfer is provided between the front portion and the front end of the end piece in order to avoid prevent the front end from cutting into the support tube during the insertion.

12. The method according to claim 1, wherein the inner surface or an outer surface of the one end of the support tube has a zinc coating.

13. The method according to claim 1, wherein the end piece is formed with at least one radial discharge passage or at least one longitudinally extending groove.

14. The method according to claim 1, wherein the end piece has a wall thickness between 2 mm and 4 mm at the front portion of the end piece.

15. The method defined in claim 1, wherein the cavity has an overall length that is at least 80% of the front inner diameter.

16. The method defined in claim 1, wherein the rear portion extends over a length of about 4 mm.

17. The method defined in claim 1, wherein the front inner diameter is oversized radially 0.4 mm to 0.8 mm relative to the rear inner diameter.

18. The method defined in claim 1, wherein the front inner diameter is oversized radially by less than 0.5 mm to 0.1 mm relative to the outer diameter of the one end of the support tube.

* * * * *